US005269032A

United States Patent [19]

Flocks

[11] Patent Number: 5,269,032

[45] Date of Patent: Dec. 14, 1993

[54] PORTABLE, READILY ASSEMBLED, EASILY UPHOLSTERED HEADBOARD

[76] Inventor: John Flocks, 14650 Southlawn La., Rockville, Md. 20850

[21] Appl. No.: 965,760

[22] Filed: Oct. 23, 1992

[51] Int. Cl.[5] ..... A43C 19/00

[52] U.S. Cl. ..... 5/285; 5/53.1; 5/280; 5/303

[58] Field of Search ..... 5/53.1, 201, 280, 282.1, 5/285, 303

[56] References Cited

U.S. PATENT DOCUMENTS

| | | | |
|---|---|---|---|
| 121,734 | 12/1871 | Springer | 5/288 |
| 1,052,784 | 2/1913 | Adams | 5/282.1 |
| 1,061,487 | 5/1913 | Moore | 5/280 |
| 1,070,814 | 8/1913 | Kimball | 5/282.1 |
| 1,998,138 | 4/1935 | Kiesecker | 5/280 |
| 2,550,762 | 5/1951 | Bockus | 5/280 |
| 3,414,912 | 12/1968 | Dosey | 5/280 |
| 3,546,725 | 12/1970 | Tambascio | 5/280 |

FOREIGN PATENT DOCUMENTS

| | | | |
|---|---|---|---|
| 346154 | 11/1904 | France | 5/280 |
| 2635957 | 3/1990 | France | 5/53.1 |
| 828172 | 2/1960 | United Kingdom | 5/53.1 |

*Primary Examiner*—Peter M. Cuomo
*Assistant Examiner*—Flemming Saether
*Attorney, Agent, or Firm*—Karl W. Flocks

[57] ABSTRACT

A portable, readily assembled, easily upholstered and re-upholstered headboard of two posts or stiles, two inter-fitting rails which are readily assembled and locked to the posts or stiles without tools, and a muslin or a muslin-like covered cushioned panel having a backing rigid sheet provided with rail-engaging formations.

10 Claims, 5 Drawing Sheets

PORTABLE, READILY ASSEMBLED, EASILY UPHOLSTERED HEADBOARD

This invention relates to headboards and more particularly to a portable headboard.

BACKGROUND

Headboards have conventionally been made of various materials, including wood, steel, and brass. Headboards are associated with frame members for supporting a spring and mattress which frame may also, in some instances, be attached to a footboard as well as to a headboard. Conventionally, headboards are taller than footboards. The means for supporting the mattress may include two side rails associated with a headboard and a footboard or a self-supporting frame. One such self-supporting frame which is well known is the "Harvard" bed frame. Many users have employed "Harvard" bedframes with headboards and have found that it is unnecessary to have a footboard.

In the past, decorators and users of beds utilizing a headboard and a "Harvard" frame or a frame like a "Harvard" frame have paid attention to color and coordination with other elements or fabrics in the bedroom, such as draperies, for example. Manufacturers of bed clothes, including sheets, pillow cases, skirts, and bed covers, including quilts, have departed from the basic white and have gone over to the use of solid colors, stripes, floral designs, and other motifs.

In the past, decorators and users of bedroom furniture have shown a tendency to coordinate the headboard with other colors or fabrics that are used or appear in the bedroom.

The normal upholstered headboard involves a labor-intensive process which is expensive. Efforts have been made to assist the user in a "do-it-yourself" process of upholstering a headboard in a manner to include a matching or harmonizing fabric corresponding to colors or fabrics which appear in the bedroom.

However, all the headboards which include a rigid frame are not readily portable. Indeed, when they are purchased it is almost always necessary to have them delivered, unless the individual customer appears at the place of sale with a pick-up truck or a van or a station wagon.

OBJECTS AND ADVANTAGES

It is an object of the instant invention to provide for the decorator or user a portable headboard which can be carried from the place of purchase in a paperboard carton or sack.

It is another object of the instant invention to provide a portable headboard in the form of posts or stiles and a cushion-back ready to receive a final upholstery fabric or cover and with a manual locking arrangement for assembly not requiring any tools.

It is still another object of the instant invention to provide a portable headboard which can be readily carried by a user or messenger, as distinguished from unportable headboards which can be carried only by truck or trucking service or the like.

Other objects and advantages will become apparent when reference is made to the drawings appended hereto and the following description:

Figure 1:
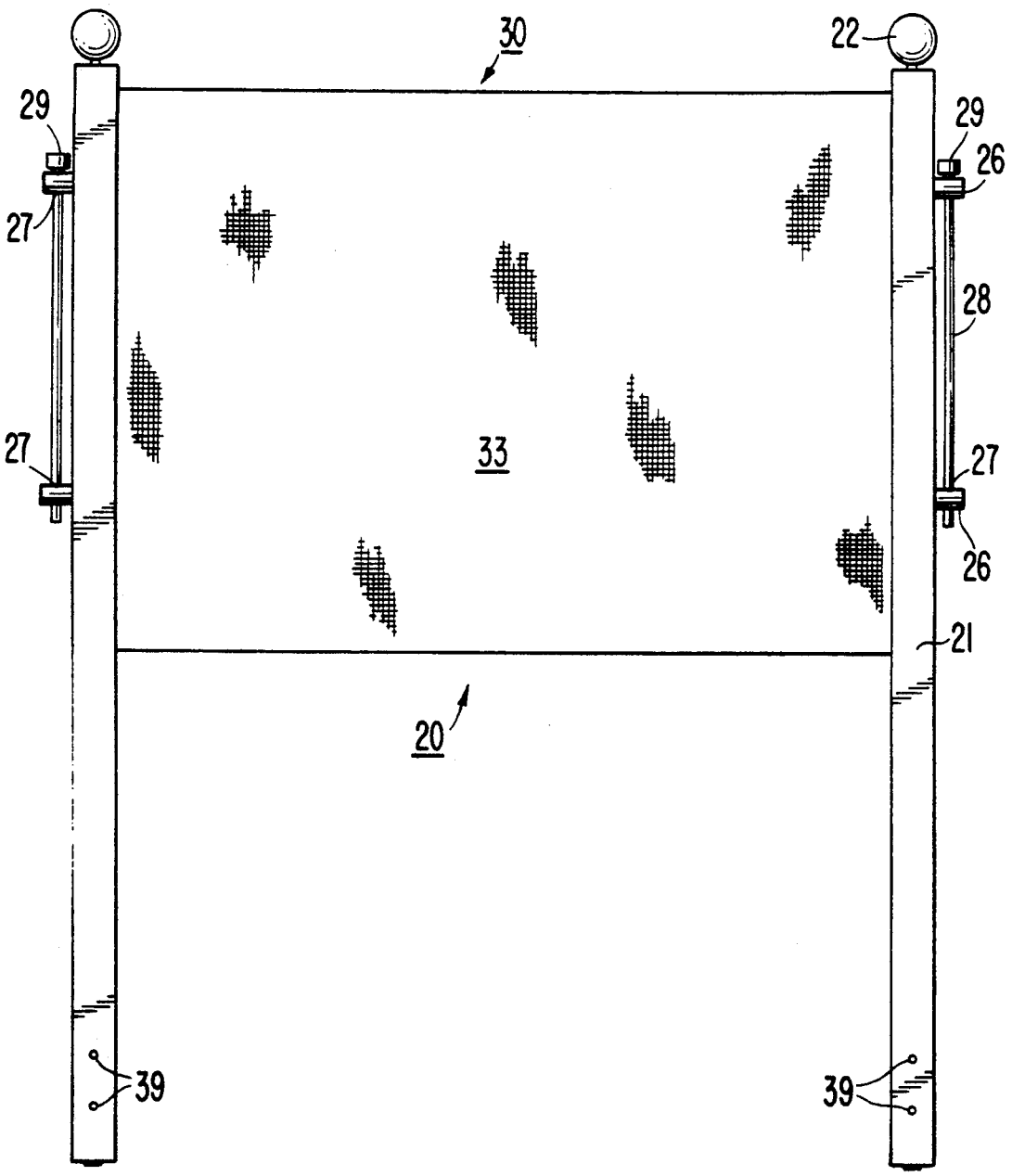
FIG. 1 is a view in front elevation of an assembled portable headboard in accordance with the invention.

Referring to the drawings and more particularly the FIGS. 1, 2, 3, and 4, the individual posts or stiles 21 are erected to vertical position and engaged by the horizontal rails 24. The rail shoulders 25 engage the vertical inner sides of the posts or stiles 21 and the rail cylindrical projections 26 which extend from the rails 24 pass through the horizontal bores 23 in the posts or stiles 21. Extending through the vertical bores 27 in the rail projections 26 are the elongated pins or cotter rods 28 which are provided with heads or caps 29. The two vertically spaced holes 39 near the bottom of each post or stile 21 accommodate bolts or carriage bolts for securing the headboard to a bed frame like a "Harvard" bed frame, not shown.

Figure 4:
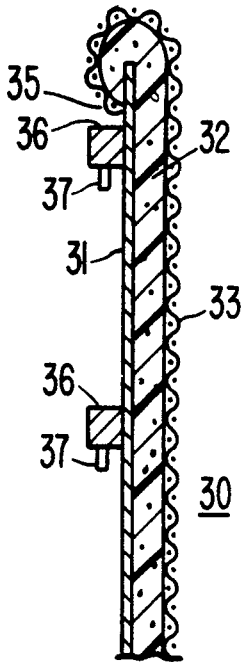
FIG. 4 is a fragmentary vertical section taken through the center of the back element of the headboard illustrated in FIG. 1.

FIG. 4 shown in vertical cross section, is of a fragment of the back panel 30 which forms part of the headboard 20. This back panel includes a rigid back sheet 31 which may be made of plywood and is overlaid with a foam cushion material 32 which may be of synthetic plastic having some of the characteristics of natural rubber. The foam cushion in section is in the shape of an inverted "J" which imparts to the top of the back panel a pleasing rounded form. Overlying the foam cushion 32 is the muslin-like fabric 33 which serves as an underlayment for the formal decorator-type fabric 34 illustrated in FIG. 1A.

Secured to the back of the rigid sheet 31 in horizontal orientation are the rail engaging members 36 from which vertically extend downwardly in horizontally-spaced relation two locator pins 37 which are adapted to be inserted and mesh with the locator sockets 38 formed in the upper surface of the rails 24 in horizontally spaced relationship.

Figure 2:
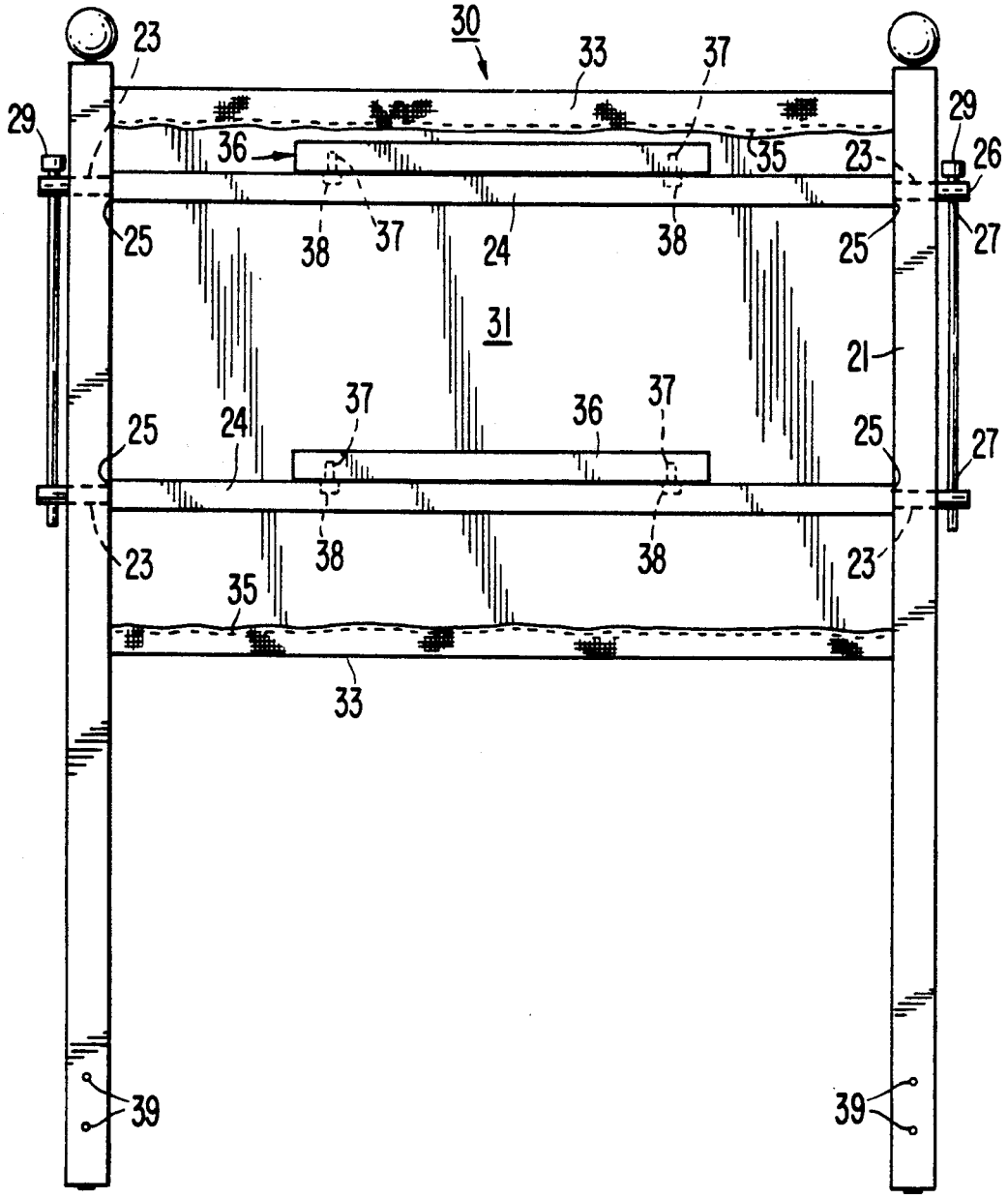
FIG. 2 is a view in rear elevation of the portable headboard illustrated in FIG. 1.

The muslin-like material 33 is secured to the rigid sheet 31 by staples or thumb tacks 33, as shown in FIG. 2.

Figure 1A:
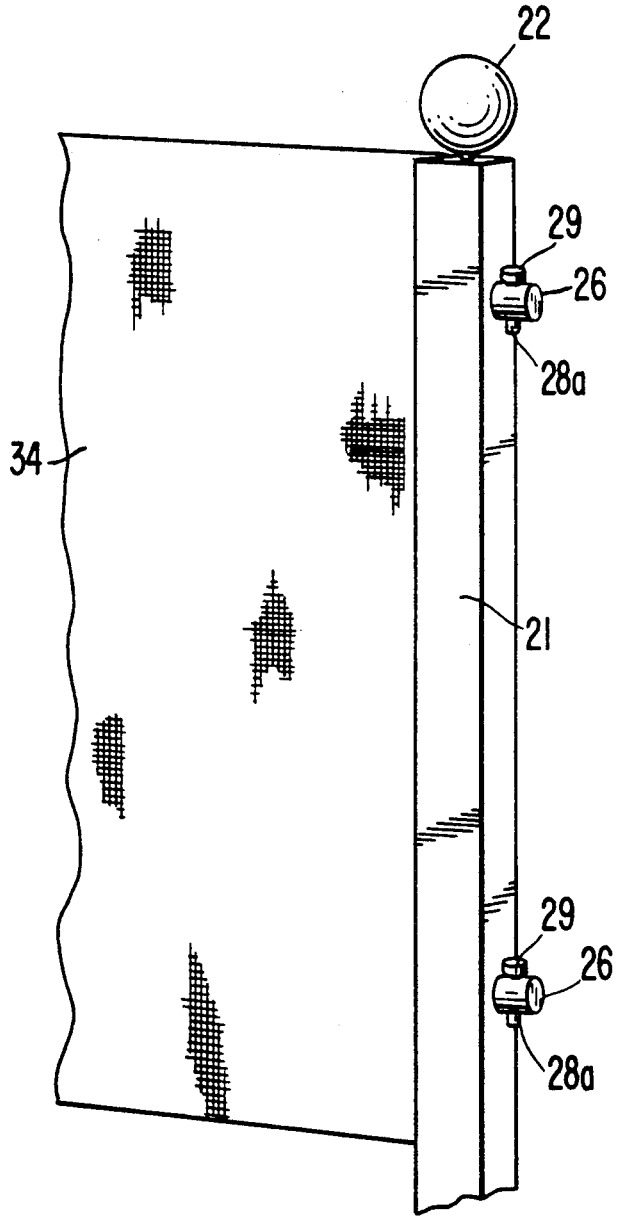
FIG. 1A is a portion of a photograph of a portable headboard in accordance with the invention in which individual short cotter rods are utilized in a modification or alternative arrangement to that illustrated in FIG. 1 wherein elongated pins or cotter rods are utilized.

When it is desired to change the fabric on the removable panel of the headboard, it is necessary only to lift the panel vertically and move it horizontally out of the way of the rails and stiles and then cover the muslin-like material with formal decorator-type fabric 34, as illustrated in FIG. 1A with the utilization of staples or thumb tacks applied to the exposed back or rear of the headboard panel, as viewed in FIG. 2.

Figure 3:
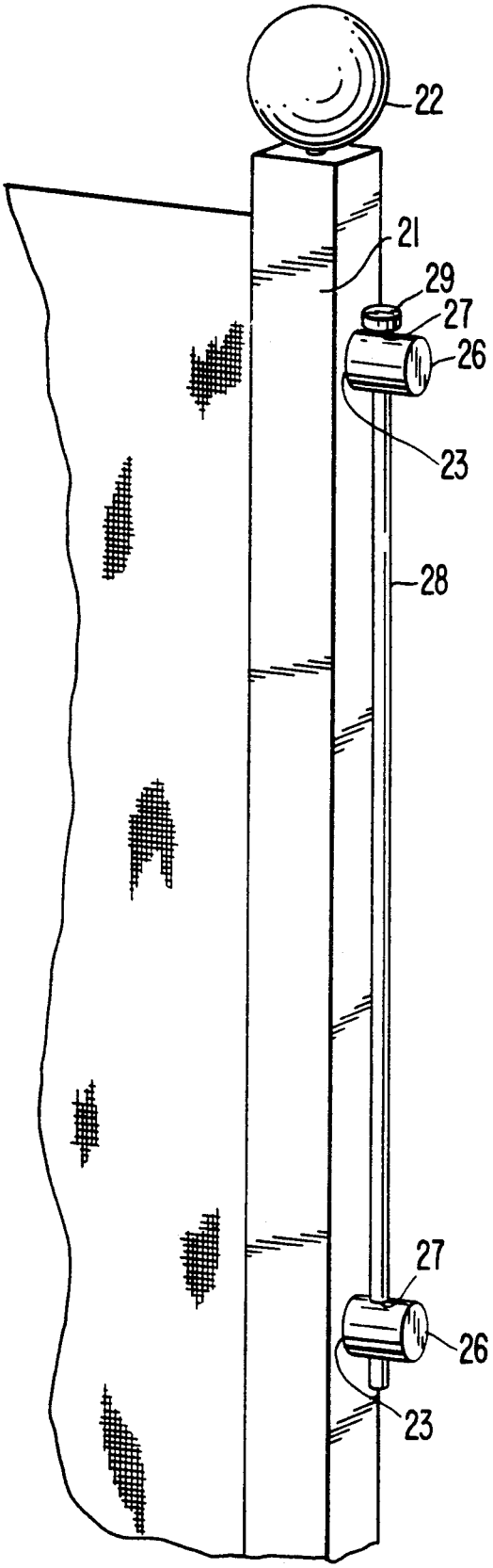
FIG. 3 is an enlarged fragmentary perspective view illustrating a post, a finial thereon, some elements of the locking arrangement and a fragment of the cushioned back of the headboard.

FIG. 1A is similar to FIG. 3 but illustrates a modified form of locking the horizontal rails 24 to the vertical posts or stiles 21. FIG. 1A illustrates short pins or cotter rods 28a at the end of each individual rail project 26, whereas in FIG. 3 the single elongated pin or cotter rod is utilized for this purpose.

Figure 5:
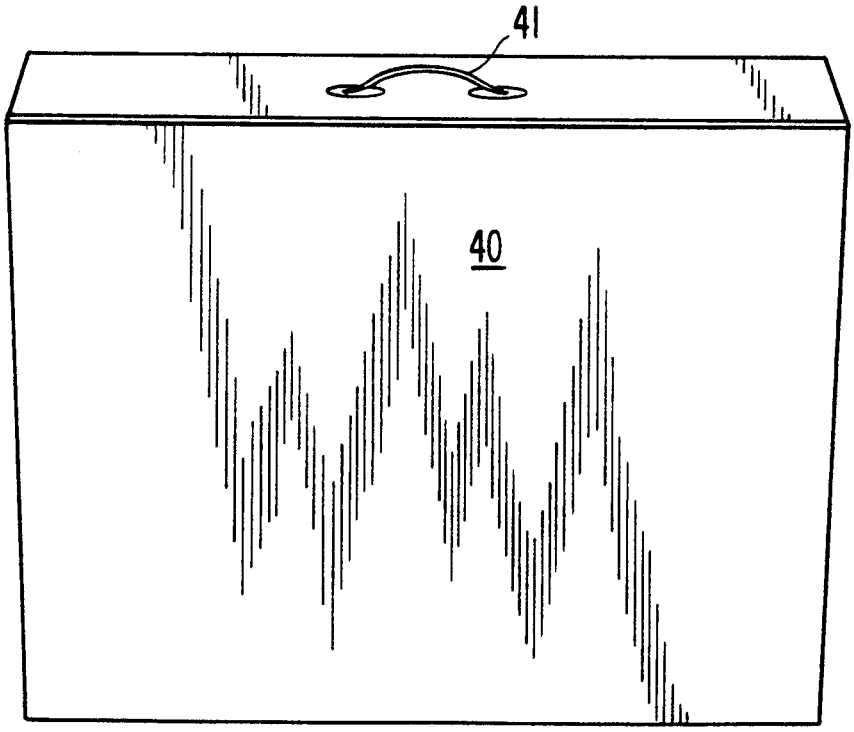
FIG. 5 is a view in perspective of the paperboard carton with a handle thereon for carrying the portable headboard from the place of purchase to the place of use.

Referring to FIG. 5, the paperboard carton 40 provided with a simple handle 41 may be used for carrying the parts of the portable headboard already described when the headboard is for a single bed or a bed of "twin" size. The width of the carton from left to right may be determined by the height of the posts or stiles. The height of the carton 40 will be determined by the height of the headboard panel which usually remains constant for the different sizes of the headboard; namely, "twin", "double", "queen", and "king".

Instead of using the carton 40 for carrying the unassembled headboard from the place of purchase to the place of use where it is to be erected, a flexible bag, not shown, may be utilized. Whether a carton or a bag is utilized, the attendant saving of the delivery charge will be significant. The assembly of the parts when they are removed from the carton 40 or the flexible bag which may take its place, is readily accomplished by the use of a simple manual operation and without the need of any tools.

To the great satisfaction of the ultimate user, the instant invention provides a less expensive finished headboard, completely upholstered in a manner to effect a highly desirable harmonizing furniture piece which is structurally sound and comfortable in its cushioning characteristics.

It is to be understood that the Specification and Drawings herein set forth and appended hereto are examples of the instant invention which is found in the Claims which follow as not only literally set forth but in accordance with the Doctrine of Equivalents.

What is claimed is:

1. A portable, readily assembled, easily upholstered headboard adapted to be carried or shipped in an unassembled array in a simple package comprising two solid wooden posts of one wood specie and an upholstered panel sub-assembly, and which, when assembled, is rigid with said panel and locked in a right angle position, fastening means for releasably fastening said panel to said posts, said fastening means including two horizontal, vertically spaced rails, each having two ends each of said ends having a shoulder which bears against an inner side of one of said posts, external fastening elements bear against an outer side of each of said posts such that said posts are securely fastened to said rails at right angles between said shoulders and said fastening elements, vertically spaced horizontal strips secured to a rear side of said upholstered panel each of said horizontal strips being provided with downwardly directed engaging members extending therefrom, upper sides of each of said vertically spaced rails having horizontally spaced receiving formations for releasably receiving said engaging members.

2. A portable readily assembled, easily upholstered headboard in accordance with claim 1, two vertically spaced horizontal rails, said panel being provided with two vertically spaced horizontal rail engaging members, said two rails and said two rail-engaging members forming part of said means for releasably locking said panel to said posts.

3. A portable, readily assembled, easily upholstered headboard in accordance with claim 2, each of said horizontal rail engaging members having vertically extending horizontally spaced locating pins for engaging with horizontally spaced sockets formed in said two vertically spaced horizontal rails.

4. A portable, readily assembled, easily upholstered headboard in accordance with claim 3, each of said posts being formed with two vertically spaced horizontal openings extending completely therethrough, the ends of each horizontal rail extending completely through and beyond said openings.

5. A portable, readily assembled, easily upholstered headboard in accordance with claim 2, each of said posts being formed with two vertically spaced horizontal openings extending completely therethrough, the ends of each horizontal rail extending completely through and beyond said openings.

6. A portable, readily assembled, easily upholstered headboard in accordance with claim 5, each rail having a body engaging panel portion of rectilinear cross section, a projecting end of circular cross section and a shoulder between said body engaging panel portion and said projecting end.

7. A portable, readily assembled, easily upholstered headboard in accordance with claim 6, each projecting end having a vertical bore extending therethrough adjacent its extremity.

8. A portable, readily assembled, easily upholstered headboard in accordance with claim 7, an elongated pin extending through a pair of vertically aligned vertically spaced bores extending through the projecting ends of circular cross section which project from each of said rails, said elongated pin having a wooden cap or head.

9. A portable, readily assembled, easily upholstered headboard in accordance with claim 8, wherein each wooden post of one specie is capped with a wooden finial of a second contrasting specie which is the same as the specie of the wooden cap or head of the elongated pin.

10. A portable, readily assembled, easily upholstered headboard in accordance with claim 7, wherein said rails support horizontal rail engaging members and wherein the said releasable panel sub-assembly comprises a rear rigid sheet, and wherein said horizontal rail-engaging members are connected to the rear of said rigid sheet, said rigid sheet being covered on its front side with a layer of resilient cushion material which extends upwardly from the front of the panel back to the uppermost margin of the panel back and continues over the top thereof and then in direction downwardly on the rear side thereof so that, in cross section, the cushion is generally in the form of an inverted "J", the said cushion is covered with an underlayment of muslin-like woven material and is ready to receive a final cover of readily replaceable upholstery material to meet requirements of a decorator or match a color scheme of a user.

* * * * *